United States Patent [19]

Stiffler

[11] 4,083,653

[45] Apr. 11, 1978

[54] STIRRING DEVICE

[76] Inventor: Hugh A. Stiffler, 956 N. Layman Ave., Indianapolis, Ind. 46219

[21] Appl. No.: 768,340

[22] Filed: Feb. 14, 1977

Related U.S. Application Data

[63] Continuation of Ser. No. 630,010, Nov. 7, 1975, abandoned.

[51] Int. Cl.[2] ..... B01F 7/18

[52] U.S. Cl. ..... 416/142; 416/231 A; 366/329

[58] Field of Search ..... 416/231 A, 142; 259/106, 107, 111, 114.4

[56] References Cited

U.S. PATENT DOCUMENTS

| | | | |
|---|---|---|---|
| 579,668 | 3/1897 | Wilson | 416/231 A X |
| 609,270 | 8/1898 | Flaherty | 416/142 |
| 1,218,623 | 3/1917 | Brillhart | 416/142 X |
| 1,728,768 | 9/1929 | O'Conner | 416/142 X |
| 1,734,120 | 11/1929 | Farrington | 416/142 X |
| 2,896,926 | 7/1959 | Chapman | 416/142 X |
| 3,030,083 | 4/1962 | Stiffler | 416/231 A X |
| 3,455,540 | 7/1969 | Marcmann | 416/142 |
| 3,559,962 | 2/1971 | Enssle | 416/142 X |

*Primary Examiner*—Everette A. Powell, Jr.
*Attorney, Agent, or Firm*—Woodard, Weikart, Emhardt & Naughton

[57] ABSTRACT

A stirring device employs a shaft-mounted hub with five axially nested, radially extendable fins shaped to not only provide compact nesting of five fins to enter a bung opening of a drum, but also to provide ample surface area when extended for stirring.

9 Claims, 7 Drawing Figures

STIRRING DEVICE

This is a continuation of application Ser. No. 630,010, filed Nov. 7, 1975, now abandoned.

BACKGROUND OF THE INVENTION

1. Field of the Invention

This invention relates generally to stirring devices, and more particularly to expandable stirrers useful for insertion through small bung openings but expandable when the stirrer shaft is rotated for stirring the container contents.

2. Description of the Prior Art

In addition to the agitator wheel of my U.S. Pat. No. 3,030,083, and the devices of the references cited therein, I have become aware of some additional stirring or mixing devices as disclosed and described in United States Patents as follows:

| Patent No. | Inventor | Issue Date |
|---|---|---|
| 1,218,623 | Brillhart | 3-13-17 |
| 1,447,653 | Fish | 3-06-23 |
| 1,734,120 | Farrington | 11-05-29 |
| 2,045,710 | Haywood | 6-30-36 |
| 3,223,389 | Simmonds | 12-14-65 |
| 3,455,540 | Marcmann | 7-15-69 |
| 3,559,962 | Enssle | 2-02-71 |

Although I am not certain as to marketing of devices other than that shown in my above-mentioned patent, I am aware that some stirring devices similar or identical to that shown in the Enssle U.S. Pat. No. 3,559,962 have been marketed. There has remained a need for greater stirring capability combined with smooth action and convenience in use. The present invention is the result of efforts in that direction.

SUMMARY OF THE INVENTION

Described briefly, in a typical embodiment of the present invention, a hub is provided with a plurality of vanes foldable thereon from radially extending to axially extending nested position, the vanes being so contoured as to nest conveniently together near the axis but nevertheless have adequate surface area for good performance when radially extended.

DESCRIPTION OF THE PREFERRED EMBODIMENT

Figure 1:
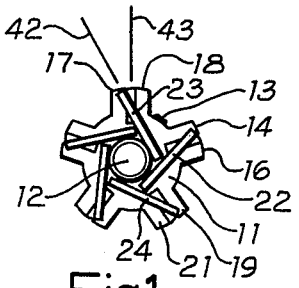
FIG. 1 is an end view of a stirrer according to a typical embodiment of the present invention, looking at the stirrer from the end toward which the blades or fins are folded.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
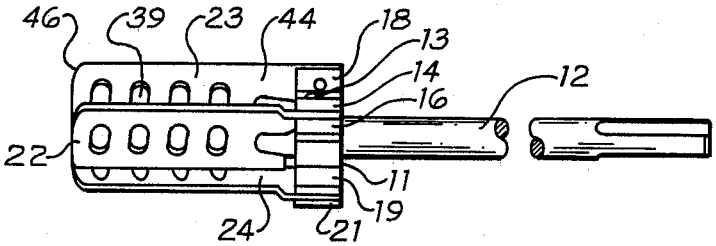
FIG. 2 is a side elevational view of the stirrer of FIG. 1.
Figure 3:
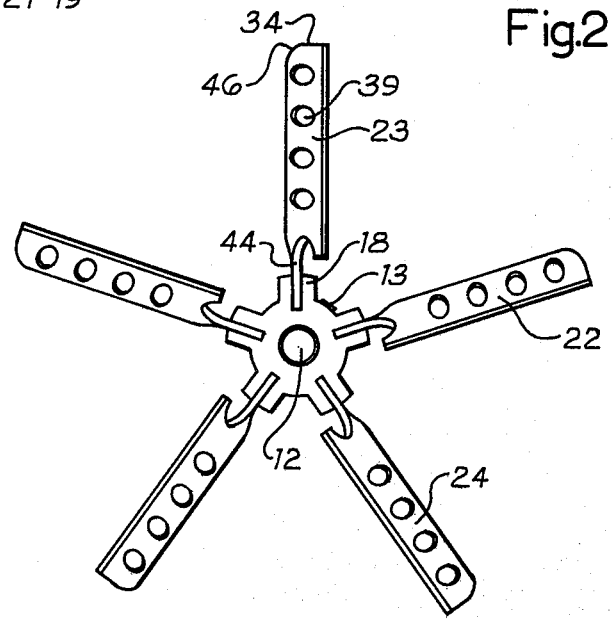
FIG. 3 is an end or face view of the hub with the blades extended.

Referring now to the drawings in detail, the stirring device includes a generally circular hub 11 secured to the shaft 12 by means of a set screw 13. The hub has five pairs of vane-mounting lugs such as the pairs 14–16, 17–18 and 19–21, for example. These serve as mounts for the vanes 22, 23 and 24, respectively. Similar lug pairs serve as the mounts for the other two vanes. As shown in FIG. 2, the set screw is received in the hub between the lugs 14 and 18. The terms "vanes," "fins," or "blades" may be used interchangeably herein.

Figure 4:
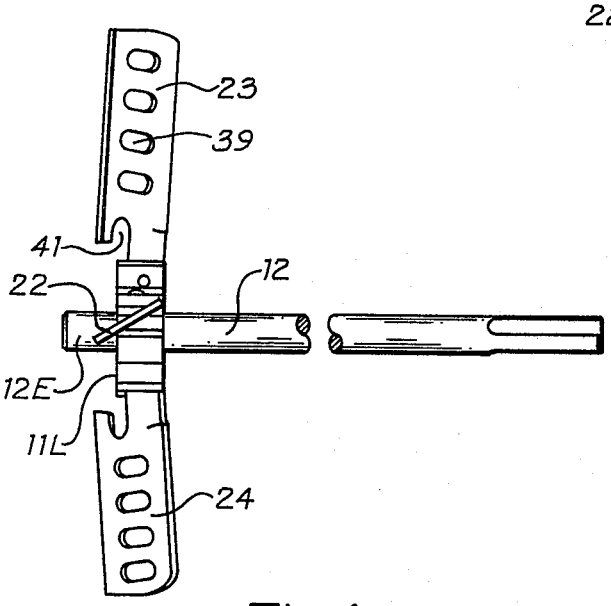
FIG. 4 is a side view with the blades extended.
Figure 5:
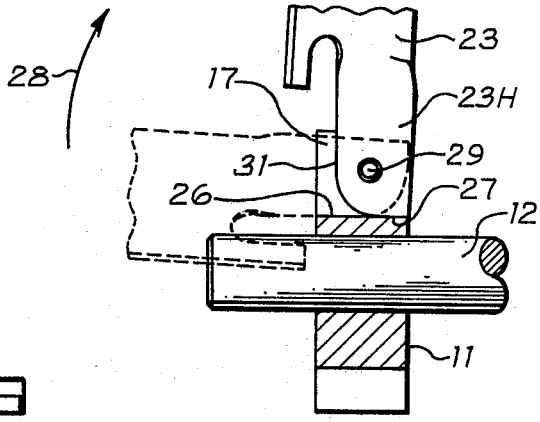
FIG. 5 is an enlarged fragmentary section through the hub on the shaft axis and showing details of the blade mounting.

FIG. 5 shows details of mounting of the fin to the hub and the details shown in this Figure are typical for all five fins. In this instance, it can be seen that in the hub 11, the bottom surface 26 of the slot between lugs 17 and 18, is flat. Being flat and parallel to the shaft axis, it serves as an abutment for the flat end 27 of the hub portion 23H of the fin 23 to limit outward movement of the fin in the direction of arrow 28 from the dotted line position to the solid line position in FIG. 5. Therefore, as the shaft of the stirrer is rotated, and centrifugal force causes the fins to pivot outward about the pivot pins 29 by which they are connected to the lug pairs, the slot bottoms, such as 26, provide an abutment stop for the fins so that they stop their outward extension in the position shown in FIGS. 4 and 5.

The bottom surface 26 also serves as an abutment stop for the flat edge 31 of the fin as it is folded from the extended to the nested position of FIGS. 1 and 2. When it is in this nested position, the maximum dimension across the assembly in any direction or plane perpendicular to the shaft axis is $1\frac{7}{8}$ inches. This enables it to be readily inserted through the bung opening 32 of the drum 33 of FIGS. 6 and 7. This opening is typically 2 inches in diameter.

The length of each blade is preferably $3\frac{1}{4}$ inches measured outward from the pivot pin 29 to the distal end or blade tip 34. With such dimensions, the effective diameter of the unit when expanded for stirring is 8 inches. In contrast, the overall diameter of the circle of the lugs is $1\frac{7}{8}$ inches.

Figure 6:
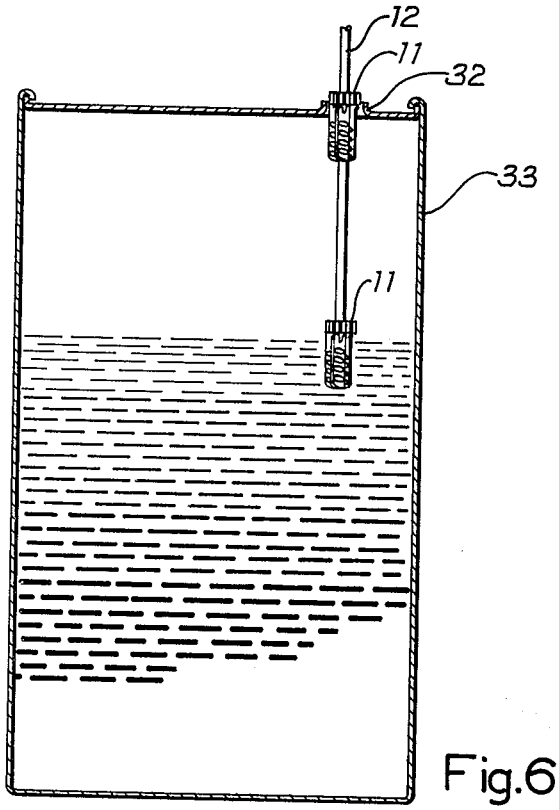
FIG. 6 is a section through a 55-gallon drum receiving a two-wheeled stirrer through a bung opening in the top.

Referring further to FIG. 6, where two vane wheels are employed, the distance between hubs, measured along the shaft, is preferably about 12 inches. The shaft diameter preferably is $\frac{1}{2}$ inch and it may be electrically or air powered. The drill motor and chuck are shown at 36 in FIG. 7.

The preferred methods of use are as follows. For a 5-gallon container with an opening of $1\frac{7}{8}$ inches or more, one vane assembly is used. If the opening is at the side of the lid, the vane should be entered into the product in the container to a depth of about 6 inches and angled toward the center of the container. Power should be turned on and the shaft speed established at 50–100 rpm for four or five seconds. Then the stirrer should be moved deeper into the container with more speed, but not so much as to form a vortex in the material. As the product is mixed, the stirrer vane assembly should be moved further down until eventually it touches bottom. Then the speed should be slowed to approximately 50 rpm and the vanes moved around the bottom of the container to wipe out unmixed material from the corners. Then the vane should be lifted and speeded up for a few seconds. Then it can be withdrawn from the container.

Figure 7:
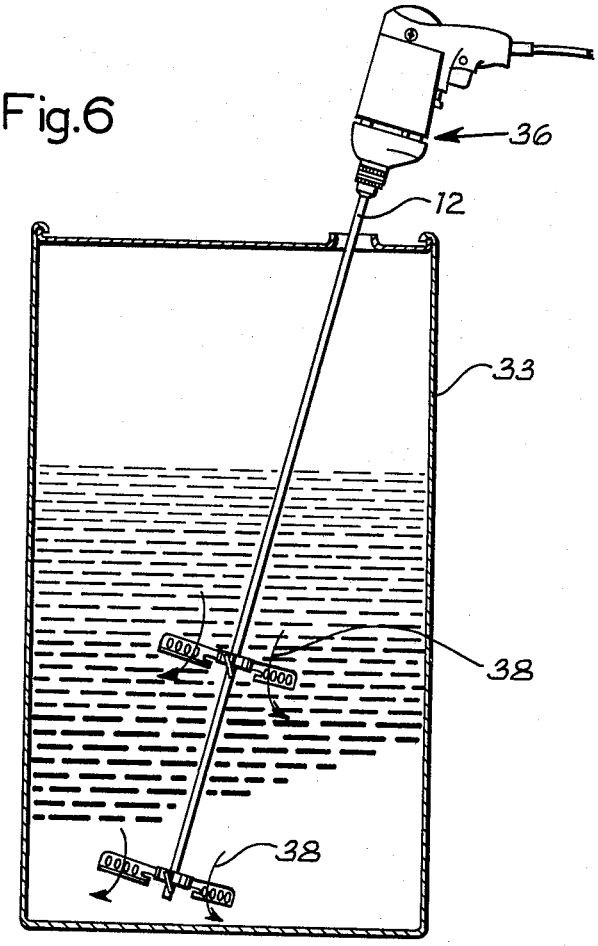
FIG. 7 is a view similar to that of FIG. 6 but showing the stirrer assembly in operation.

For a 30 or 55-gallon drum, two vane wheels should be employed as shown in FIGS. 6 and 7. The lower vane wheel can be mounted with the shaft extending below the hub approximately ¾ inch. This relationship is shown in FIG. 4 where the end portion 12E of the shaft extends beyond the face 11L of the hub. After the unit has been inserted into the drum or barrel, the motor is started and the vanes should be moved down gradually and moved from side to side like one would operate a paddle in the drum. The speed should be kept low enough to avoid a vortex, and mixing should continue for 3 to 5 minutes. Then the speed can be reduced and the lower vane wheel moved around on the bottom of the drum to wipe out the lower corners. Then it should be raised from 6 to 10 inches and run at a high speed for several minutes. Then the power is shut off and the unit lifted from the drum and placed in a container of solvent to cover the vanes, the nature of the solvent depending upon the material which has been stirred in the drum. Then upon turning on the drill and reversing the rotation, and triggering the power on and off, the activation of the vanes will assist in cleaning them both by jostling and by centrifugal force. The vanes can be completely cleaned by brushing and wiping with a small brush.

The extension of the shaft below the bottom of the hub permits resting the shaft on the bottom of the container to minimize wear on the blade tips. However, the fact that the blades are made of stainless steel, by itself minimizes wear and also minimizes the likelihood of bending in the event of contact with the wall or bottom of the drum at a sharp angle. The use of the five vanes enables comparatively steady contact if the unit is operated close to the wall of the container and thereby avoids intermittent jarring type of contact. The fact that the fins are made of stainless and thick, preferably ⅛ inch, minimizes the care needed on the part of the operator to avoid bending the fins as he is cleaning material from the bottom or sides of the container in an effort to thoroughly stir all of the material in the container.

The preferable direction of rotation of the shaft is clockwise when viewed from the motor end, with the result that the product is stirred downwardly in the direction of the arrows 38 in FIG. 7. The vanes are preferably provided with four holes each as shown at 39, and a slot at 41. In this way, much material is forced through the holes and slots, cutting up any lumps and floating solids which have been loosened from the bottom of a container of liquid. Yet there is enough blade area to function well for ample agitation of the product.

It will be noticed by reference to FIG. 1, that the plane 42, for example, of the major portion of blade 23, is skewed with respect to the plane 43 of the hub portion 44 of the blade. This facilitates the nesting of the blades together adjacent the shaft extension through the hub and also, of course, facilitates nesting of the blades of the upper vane assembly in FIGS. 6 and 7, yet it does not detract at all from the available blade area for adequately stirring the product. It will be noted that the plane of the major portion of the blades is, in each instance, tangent the shaft, while the plane of the hub portion 44 of each blade contains the shaft axis.

The round ends 46 of the blades remote from the shaft and on the outer surface thereof, facilitate entry into the bung openings. They also facilitate raising the unit in a container, particularly where the container may have ledges or grooves in the walls thereof.

I believe that my vane assembly will mix even thick settled liquid product in complete suspension, or blend added color to the product quicker by 60 or 70 percent than any device of this general type now on the market.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A stirring device comprising:

a hub having a central aperture for mounting on a shaft and a plurality of pivot means circularly spaced in said hub radially outward from said aperture;

a plurality of elongate vanes pivotally mounted to said hub around a circle to pivot from a folded idle position wherein said vanes extend parallel to the axis of said aperture, outward to working position radially outward from the axis;

each of said vanes having a mounting hub portion connected to said hub by one of said pivot means, and a distal portion remote from said hub, with a major portion of each vane from the hub portion through the distal portion being skewed with respect to said hub portion to facilitate folding said vanes close to said axis without interference with said axis, and to propel axially a liquid when said vanes are in said working position and rotated in a plane normal to said axis;

the major portion of each vane when folded having generally parallel inner and outer trailing and leading, respectively longitudinally extending edges; and the major portion of each vane, when folded, having an inner surface generally facing said axis and an outer surface generally facing away from said axis; the inner edge of each vane, when said vanes are folded, being immediately adjacent the inner surface of a vane next following it around the circle, and the inner region of the major portion having a longitudinally extending slot opening toward the hub and defining an inwardly extending trailing edge cutting part.

2. The device of claim 1 wherein:

said hub is formed of powdered heat treated and hardened stainless steel material, and said vanes are made of stainless steel about ⅛ inch thick, about 3¼ inches long from their pivots to their distal ends.

3. The device of claim 1 wherein:

said pivot means in said hub has five pairs of circularly spaced vane-mounting lugs; and there are five of said vanes, one vane being mounted to each pair of lugs; and there is a setscrew threaded in said hub between one of said pairs and the next adjacent pair and having an axis directed radially inward toward said central aperture for affixing said hub to a shaft in said aperture.

4. The device of claim 1 wherein:

said vanes have four apertures therein spaced in a row along the length of the vanes.

5. The device of claim 1 wherein:

said outer edge of each vane extends in a direction, when the vane is folded, parallel to the hub aperture axis with said outer edge curving toward said axis at the distal end of said vane.

6. The device of claim 1 wherein:

each of said vanes is about 3¼ inches long from the pivot axis thereof to the distal end.

7. The device of claim 1 and further comprising:

a shaft projecting through the aperture in said hub;

a second hub spaced from said first hub along said shaft and having a central aperture receiving said shaft therethrough;

a second plurality of vanes pivotally mounted to said second hub to pivot from a folded idle position extending parallel to the axis of said shaft, outward to working position radially outward from the shaft;

each of said vanes of said second plurality having a mounting portion connected to said second hub by pivot means, and a distal portion remote from said second hub, with a major portion of each vane of said second plurality from the hub portion through the distal portion being skewed with respect to said second hub portion to facilitate folding said vanes so that, when folded, the major portions of said vanes of said second plurality are in planes tangent the outer surface of said shaft.

8. The device of claim 7 wherein:

said hubs are about 12 inches apart.

9. The device of claim 1 wherein:

the maximum diameter of said stirring device is 1 and ⅞ inches when the vanes are folded, and 8 inches when the vanes are in working position.

* * * * *